US007365314B2

(12) United States Patent
Lee et al.

(10) Patent No.: US 7,365,314 B2
(45) Date of Patent: Apr. 29, 2008

(54) SINGLE-PARTICLE MASS SPECTROMETER

(75) Inventors: Dong-Geun Lee, Busan (KR); Seong-Woo Cho, Busan (KR)

(73) Assignee: Pusan National University Industry-University Cooperation Foundation, Pusan (KR)

( * ) Notice: Subject to any disclaimer, the term of this patent is extended or adjusted under 35 U.S.C. 154(b) by 162 days.

(21) Appl. No.: 11/377,364

(22) Filed: Mar. 17, 2006

(65) Prior Publication Data

US 2006/0214103 A1 Sep. 28, 2006

(30) Foreign Application Priority Data

Mar. 25, 2005 (KR) ..... 10-2005-0024822

(51) Int. Cl.
*H01J 49/40* (2006.01)

(52) U.S. Cl. ..... 250/287; 250/288

(58) Field of Classification Search ..... 250/287, 250/288, 281

See application file for complete search history.

(56) References Cited

U.S. PATENT DOCUMENTS 5,300,774 A * 4/1994 Buttrill, Jr. ..... 250/287
5,629,518 A * 5/1997 Grotheer et al. ..... 250/288
7,087,897 B2 * 8/2006 Bateman et al. ..... 250/287

* cited by examiner

*Primary Examiner*—Kiet T. Nguyen
(74) *Attorney, Agent, or Firm*—Stein, McEwen & Bui, LLP

(57) ABSTRACT

Disclosed is a single-particle mass spectrometer, which includes a chamber keeping an inside in a vacuum state by a vacuum pump, a cylindrical flying tube installed to communicate with the chamber, an aerodynamic lens installed to the chamber to focus aerosol particles input from outside, a laser generating means for irradiating a laser beam to the particles focused by the aerodynamic lens to emit ions, an extraction acceleration means for extracting the emitted ions and accelerating the ions to fly along the flying tube, and an ion detector installed to an end of the flying tube to detect the ions flying along the flying tube. The extraction acceleration means includes a reflector made of a conductive material with a semispherical shape and to which a relatively high voltage is applied; at least one mesh-shaped grid arranged from the reflector toward the ion detector at regular intervals, and to which a relatively low voltage is applied in comparison to the reflector; a cylindrical electrode; and an Einzel lens. Thus, the ions are biased due to a voltage difference between the reflector and the grid to fly toward the ion detector along the flying tube, and also refracted toward a central axis of the flying tube by means of the cylindrical electrode and the Einzel lens.

16 Claims, 10 Drawing Sheets

SINGLE-PARTICLE MASS SPECTROMETER

BACKGROUND OF THE INVENTION

1. Field of the Invention

The present invention relates to a single-particle mass spectrometer, and more particularly to an improved single-particle mass spectrometer capable of reducing a loss caused by a collision between a flying ion and a wall of a flying tube and thus improving a measuring efficiency of an ion detector by enhancing an ion focusing efficiency.

2. Description of the Related Art

Generally, a single-particle mass spectrometer analyzes aerosol of solid or liquid materials floating in the atmosphere so as to measure a pollution level of the atmosphere. A conventional single-particle mass spectrometer is operated in a way that, if aerosol is put into a chamber that is in a vacuum state by a vacuum pump, aerosol particles are accelerated to a chamber center due to the pressure difference and at the same time focused by an aerodynamic lens.

The aerosol particles focused by the aerodynamic lens are ionized again since a laser beam is irradiated thereto, and these ions are extracted and accelerated again and then input to a detector after flying along a cylindrical flying tube at a uniform velocity.

A conventional spectrometer includes a flat reflector to which a high voltage is applied, ion extraction grids having a mesh shape arranged in parallel with the flat reflector, and an ion acceleration grid mostly grounded. Ions are extracted due to the voltage difference between the flat reflector and the ion extraction grids, are accelerated due to the voltage difference between the ion extraction grids and the ion acceleration grid, and then fly at different speeds depending on ion masses but at a uniform velocity in the flying tube that is kept in an electrically neutral state. But there is a problem that trajectories of the ions radially emitted by laser are not focused but mostly collided with the inner wall of the flying tube and then disappeared.

In addition, if an initial kinetic energy of emitted ions is greater, more ion losses are caused. For example, in case the composition of a single particle is irregular inside the particle in a radial direction like a particle having a core-shell structure, ions generated in the particle have different kinetic energy from ions generated from the surface, and thus their measuring efficiencies are changed, which may make the ions on the surface be underestimated.

In particular, the detector generally has a small size not greater than about 25 mm, so a proportion of ions reaching the detector is very low. In fact, in case an initial kinetic energy of ions is 100 eV, it was shown that a measuring efficiency is very low, less than 1%.

SUMMARY OF THE INVENTION

The present invention is designed to solve the problems of the prior art, and therefore it is an object of the present invention to provide a single-particle mass spectrometer capable of improving a measuring efficiency by ensuring ions to reach a detector without being excessively focused or disappeared by collisions with an inner wall of a flying tube.

In addition, the present invention provides a single-particle mass spectrometer capable of effectively focusing a large number of ions ionized from a single particle and having various kinetic energies at the same time and also capable of detecting all of the ions.

In order to accomplish the above object, the present invention provides a single-particle mass spectrometer, which includes a chamber keeping an inside in a vacuum state by a vacuum pump; a cylindrical flying tube installed to communicate with the chamber; an aerodynamic lens installed to the chamber to focus aerosol particles input from outside; a laser generating means for irradiating a laser beam to the particles focused by the aerodynamic lens to emit ions; an extraction acceleration means for extracting the emitted ions and accelerating the ions to fly along the flying tube, the extraction acceleration means including: a semispherical reflector made of a conductive material and to which a relatively high voltage is applied, and at least one mesh-shaped grid arranged from the semispherical reflector toward the ion detector at regular intervals, and to which a relatively low voltage is applied in comparison to the semispherical reflector; a cylindrical electrode arranged at the same axis as the extraction acceleration means and refracting the ions flying by the extraction acceleration means toward a central axis; an Einzel lens arranged in the flying tube at regular intervals to focus the ions, accelerated and flying by means of the extraction acceleration means, toward a central axis of the flying tube; and an ion detector installed to an end of the flying tube to detect the ions flying along the flying tube, wherein the ions are extracted and accelerated by means of a voltage difference between the semispherical reflector and the grid and fly at a uniform velocity along the flying tube toward the ion detector.

Preferably, the grid includes a first mesh-shaped grid arranged from the reflector toward the ion detector at regular intervals, and to which a relatively low voltage is applied in comparison to the reflector; and a second mesh-shaped grid arranged from the first grid toward the ion detector at regular intervals, and to which a relatively low voltage is applied in comparison to the first grid, wherein the cylindrical electrode is arranged between the first grid and the second grid.

Also preferably, the second grid is grounded.

Preferably, a voltage applied to the cylindrical electrode is lower than that applied to the first grid.

Preferably, the Einzel lens is composed of three conductive tubes successively arranged, and the tubes at both sides are electrically neutral and a voltage is applied to the tube at a center so that an electric field is respectively formed between the tubes.

At this time, the chamber may include a first chamber to which the aerodynamic lens is installed; and a second chamber to which the extraction acceleration means is installed, the second chamber communicating with the flying tube.

Preferably, a skimmer for further accelerating the aerosol particles emitted from the aerodynamic lens and separating the aerosol particles from a carrier gas is provided between the first chamber and the second chamber.

In addition, the aerodynamic lens may include a cylindrical case having an inlet and an outlet and provided with a decompressing orifice injection hole; and a plurality of focusing lens members installed in the case at regular intervals and having orifice holes at centers thereof through which the aerosol particles are passed and focused.

In another aspect of the present invention, there is also provided a single-particle mass spectrometer, which includes a chamber keeping an inside in a vacuum state by a vacuum pump; a cylindrical flying tube installed to communicate with the chamber; an aerodynamic lens installed to the chamber to focus aerosol particles input from outside; a laser generating means for irradiating a laser beam to the particles focused by the aerodynamic lens to emit ions; an extraction acceleration means for extracting the emitted ions and accelerating the ions to fly along the flying tube, the extraction acceleration means including: a reflector made of a conductive material and to which a relatively high voltage is applied, and a mesh-shaped grid arranged from the reflector toward the ion detector at regular intervals; a cylindrical electrode arranged at the same axis as the extraction acceleration means and refracting the ions flying by the extraction acceleration means toward a central axis; an Einzel lens for focusing the ions, accelerated by the extraction acceleration means and focused by the cylindrical lens, toward a central axis of the flying tube, the Einzel lens including: first, second and third conductive tubes, and mesh-shaped grids respectively formed in an input surface of the first conductive tube and an output surface of the third conductive tube, wherein the first and third conductive tubes are electrically neutral and a voltage is applied to the second conductive tube at a center; and an ion detector installed to an end of the flying tube to detect the ions flying along the flying tube, wherein the ions are extracted and accelerated by means of a voltage difference between the reflector and the grid and fly at a uniform velocity along the flying tube toward the ion detector.

Preferably, the reflector has a semispherical shape.

Also preferably, a voltage lower than that applied to the semispherical reflector is applied to the grid of the extraction acceleration means, a voltage equal to or higher than that applied to the grid of the extraction acceleration means is applied to the cylindrical electrode, and a voltage lower than that applied to the reflector is applied to the conductive tube of the Einzel lens.

At this time, the Einzel lens may include a first Einzel lens adjacent to the cylindrical electrode; and a second Einzel lens adjacent to the first Einzel lens, wherein a voltage applied to the conductive lens of the second Einzel lens is lower than that applied to the conductive tube of the first Einzel lens.

Preferably, the reflector has a flat plate shape.

Also preferably, the grid of the extraction acceleration means is grounded, a voltage lower than that applied to the reflector is applied to the cylindrical electrode, and a voltage lower than applied to the reflector is applied to the conductive tube of the Einzel lens.

Preferably, a detachable flange is provided to an input end of the flying tube, and the extraction acceleration means, the cylindrical electrode and the Einzel lens are subsequently coupled on the flange by means of a pair of supports.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Hereinafter, preferred embodiments of the present invention will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

Figure 1:
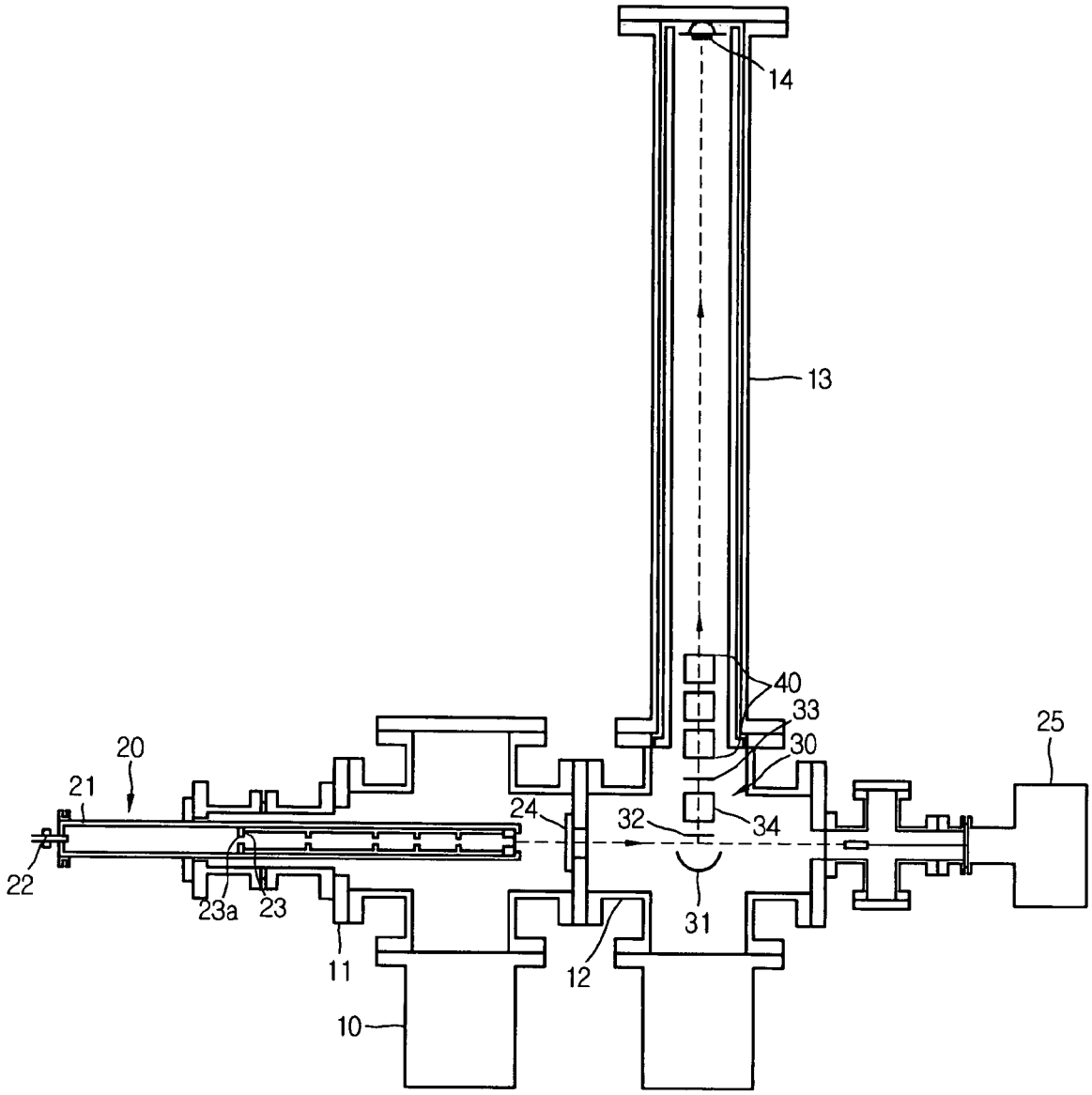
FIG. 1 is a sectional view showing a schematic configuration of a single-particle mass spectrometer according to a preferred embodiment of the present invention.

FIG. 1 schematically shows a single-particle mass spectrometer according to a preferred embodiment of the present invention.

Referring to FIG. 1, the single-particle mass spectrometer of the present invention includes a chamber 11, 12 whose inside is kept in a vacuum state. The chamber may be divided into a first chamber 11 and a second chamber 12, which are arranged in a direction that aerosol particles to be analyzed are advancing, and the insides of the first and second chambers 11, 12 are kept in a vacuum state by means of a vacuum pump 10 such as a turbo pump.

An aerodynamic lens 20 is installed to an inlet of the first chamber 11. The aerodynamic lens 20 has a cylindrical case 21 with an inlet and an outlet, and a decompressing orifice injection hole 22 is prepared in the inlet of the case 21. In addition, a plurality of focusing lens members 23 having orifice holes 23*a* formed at their centers are coaxially arranged in the case 21 at regular intervals. As explained later, if particles are input through the decompressing orifice injection hole 22, the input particles are focused as a single particle beam with passing through the orifice holes 23*a* formed in the focusing lens members 23.

A skimmer 24 is interposed between the first chamber 11 and the second chamber 12. A through hole is formed at the center of the skimmer 24, which plays a role of accelerating again the particle beam focused by the aerodynamic lens 20 and also separating the particle beam from a carrier gas.

A laser generating means (not shown) is provided to the second chamber 12 to irradiate a laser beam toward the focused particles. Preferably, the laser generating means is a Nd:YAG laser. In this case, it is known that all the particles are ionized by 100 mJ of the green Nd:YAG laser at 10 Hz.

In addition, an electrometer 25 may be further installed to the second chamber 12 so as to measure a loss when particles pass through the aerodynamic lens, the skimmer and the second chamber.

According to the present invention, an extraction acceleration means is provided in the second chamber 12 so as to extract and accelerate ions generated by ionization of the laser generating means depending on their masses.

Figure 2:
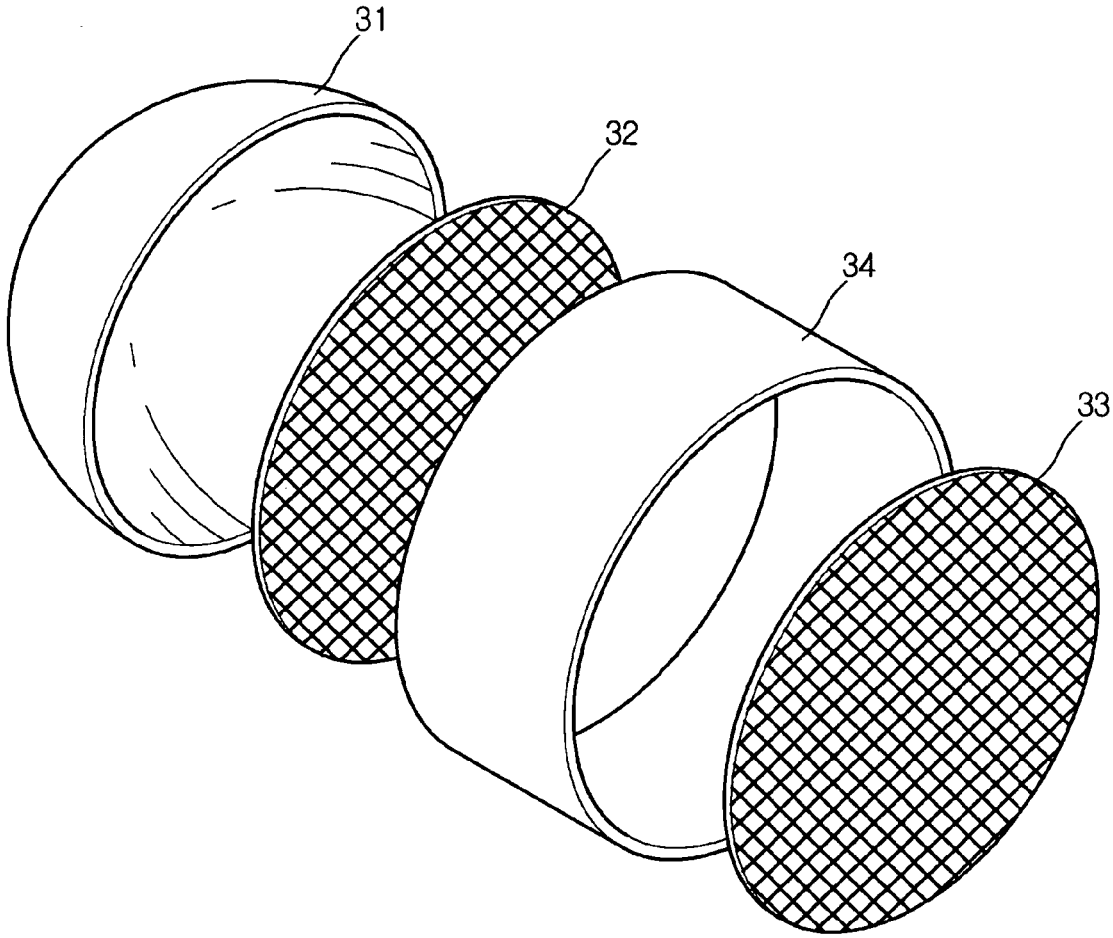
FIG. 2 is a partial perspective view showing an extraction acceleration means and a cylindrical electrode of the single-particle mass spectrometer according to the preferred embodiment of the present invention.

The extraction acceleration means 30 includes a reflector 31 and first and second grids 32, 33 as shown in FIG. 2. The reflector 31 is a conductive material with a semispherical shape and a relatively high voltage is applied to the reflector 31 so that the reflector 31 may refract the ions radially emitted as mentioned above toward a detector.

The first grid 32 has a mesh shape and is made of conductive metal, and the first grid 32 is arranged from the reflector 31 toward the ion detector at regular intervals. A relatively low voltage is applied the first grid 32 in comparison to the reflector 31, and the first grid 32 plays a role of extracting the ions ionized by laser depending on their masses.

The second grid 33 also has a mesh shape and is made of conductive metal. The second grid 33 is spaced apart from the first grid 32 by a predetermined distance, and a relatively low voltage is applied to the second grid 33 in comparison to the first grid 32, or preferably the second grid 33 is grounded. The ions extracted by the operation of the first grid 32 are biased and accelerated due to the voltage difference between the second grid 33 and the reflector 31, and then pass through the meshes of the first and second grids 32, 33 and fly in the flying tube at a uniform velocity.

The ions biased by the voltage difference between the reflector 31 and the first and second grids 32, 33 fly from the reflector 31 through the first and second grids 32, 33 toward a detector, described later.

In addition, a cylindrical electrode 34 is interposed between the first grid 32 and the second grid 33. This cylindrical electrode 34 is arranged on the same axis as the extraction acceleration means 30 and firstly focuses the accelerated ions so that the ions may fly substantially in parallel to the flying tube. A voltage applied to the cylindrical electrode 34 is equal to or higher than a voltage applied to the first grid 32.

In case a relatively low voltage of several thousand V is applied to the reflector 31, the first grid 32 is grounded or a very low voltage is applied to the first grid 32 so that a voltage difference for ion extraction and acceleration is sufficiently great. It is because ion are excessively focused if the ions radially emitted from the particle go away from the co-axis when being input to the cylindrical electrode 34 through the first grid 32.

A cylindrical flying tube 13 is installed to the second chamber 12 to communicate with the second chamber 12 so that the accelerated ions may fly therein. The flying tube 13 is kept in an electrically neutral state, and ions make uniform motions in the flying tube 13.

An ion detector 14 is installed to an end of the flying tube 13 to detect ions and analyze their mass spectrums. The ion detector 14 may adopt a MCP (Multi-Channel Plate) detector purchasable from R. M. Jordan Company Inc. in USA, as an example, and the configuration of such an ion detector is well known in the art and not described in detail here.

An Einzel lens 40 is provided in the flying tube 13 and focuses the ions, accelerated by the acceleration means and flying in parallel, toward a central axis of the flying tube 13.

Figure 3:
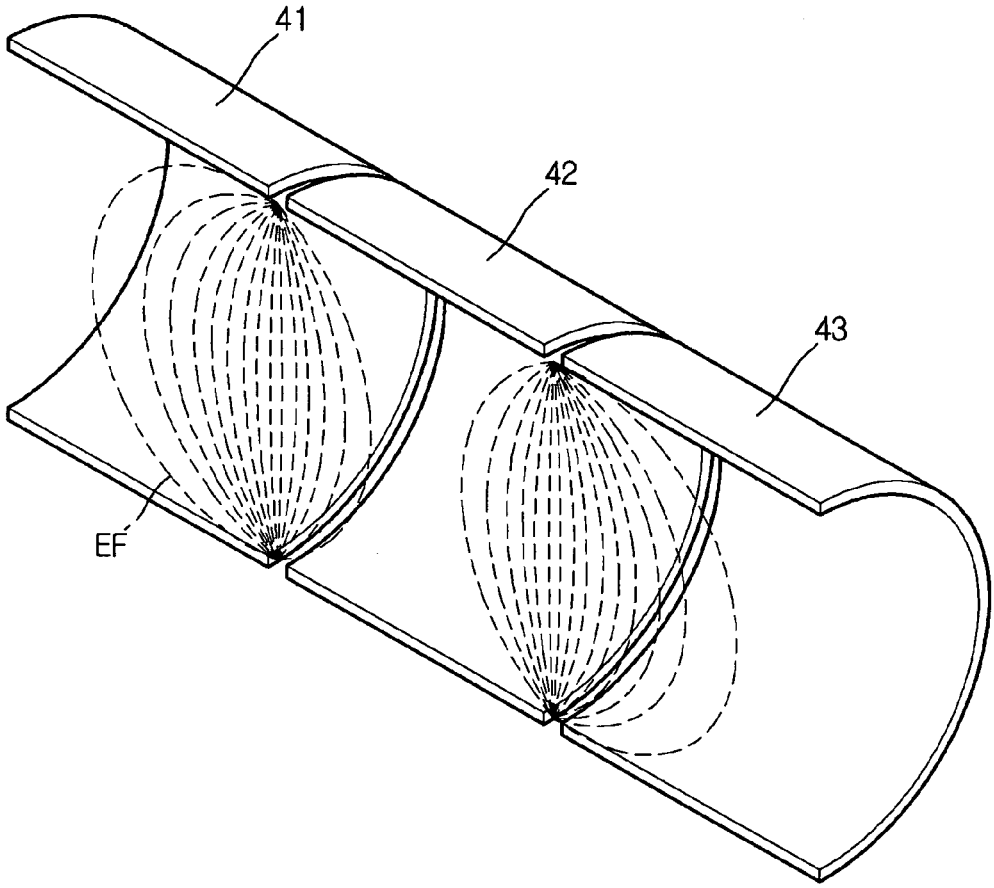
FIG. 3 is a partially-sectioned perspective view showing an Einzel lens of the single-particle mass spectrometer according to the preferred embodiment of the present invention.

The Einzel lens 40 is composed of three conductive tubes 41, 42, 43 successively arranged as shown in FIG. 3. The tubes 41, 43 at both sides are electrically neutral, but a high voltage, for example a voltage over +1,000 V, is applied to the tube 42 at the center. Thus, electric fields (EF) are respectively formed between the tubes 41, 42, 43 so that the flying ions may be focused to the detector.

Now, the operation of the single-particle mass spectrometer according to the present invention configured as mentioned above is described in detail.

First, while the chambers 11, 12 keep their insides in a vacuum state by means of the operation of the vacuum pump 10, aerosol to be analyzed is input through the decompressing orifice injection hole 22 of the aerodynamic lens 20.

The input aerosol advances into the chambers 11, 12 through the aerodynamic lens 20 due to the vacuum pressure difference from the inside of chamber. At this time, aerosol particles are focused into a particle beam shape with passing through the aerodynamic lens 20 and the orifice holes 23*a* in order, as shown in FIG. 4*a*.

Figure 4A:
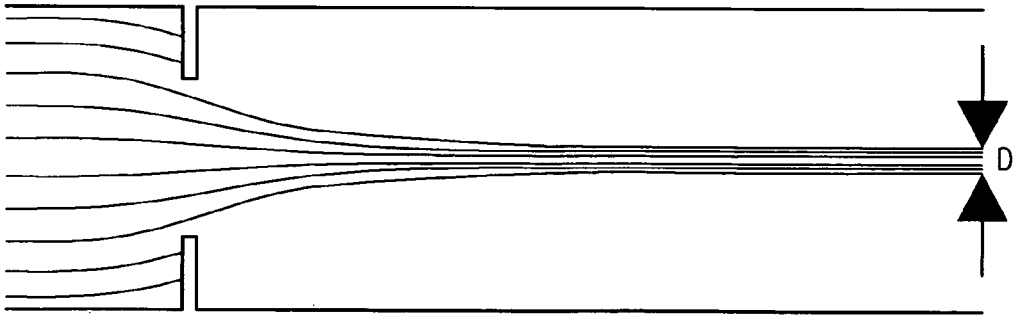
FIG. 4*a* is a sectional view illustrating that aerosol particles are focused by an aerodynamic lens in the single-particle mass spectrometer according to the preferred embodiment of the present invention.
Figure 4B:
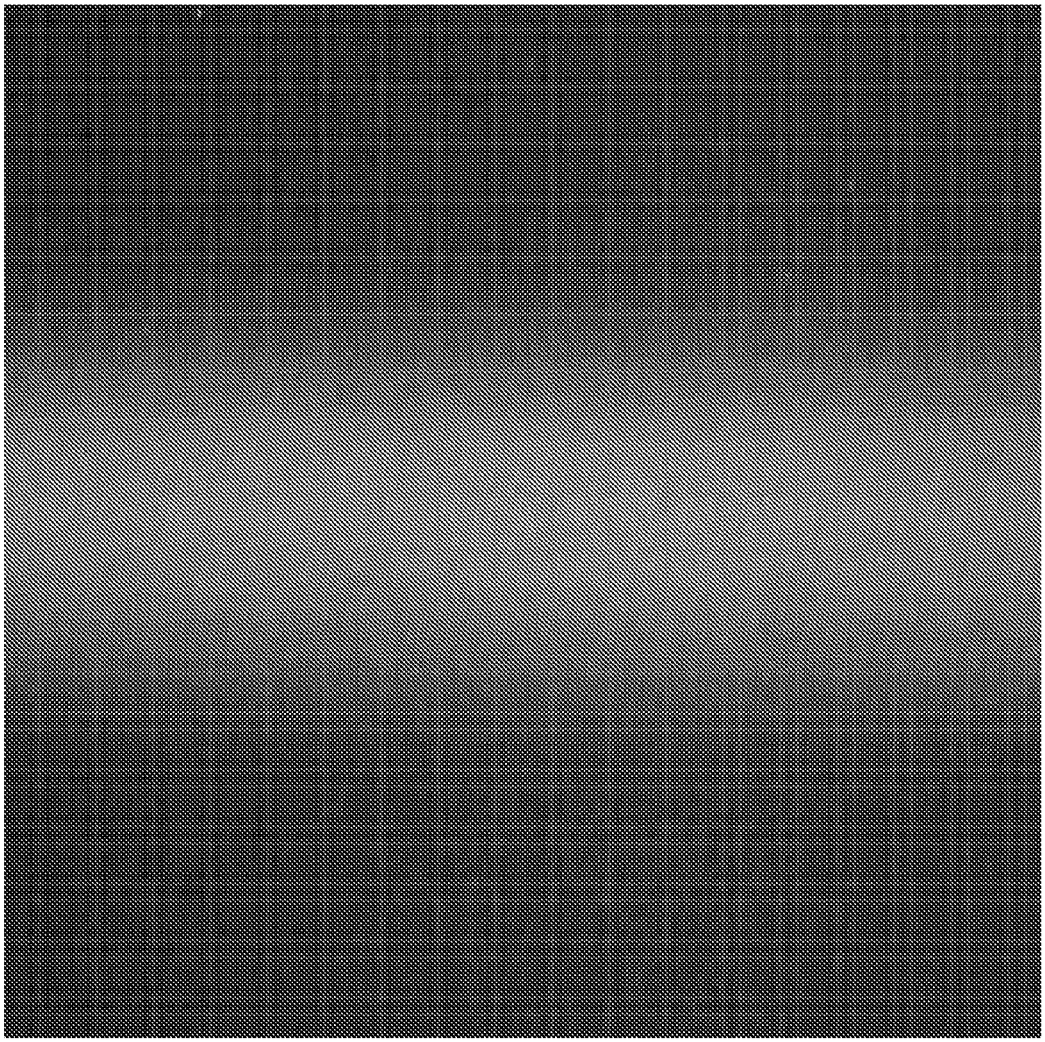
FIG. 4*b* is a photograph in which the aerosol particles focused by the aerodynamic lens are visibly shown using light diffusion.

Referring to FIG. 4*a*, the aerosol particles flowing in the aerodynamic lens 20 get out of the orifice holes 23*a* with colliding against the focusing lens members 23. In this procedure, the particles are focused toward a central axis, and they are finally focused into a shape of particle beam with passing through the multi-stage focusing lens members 23. That is to say, the carrier gas of the aerosol repeats expansion and contraction with passing through the orifice holes 23*a*, but the particles having inertia are separated from fluid and gradually focused toward the central axis. As a result of such action, it may be found that nano particles form a particle beam of about 0.8 mm in the second chamber.

The aerosol particles focused by the aerodynamic lens 20 are further focused with passing through the skimmer 24, and then reaches the extraction acceleration means as shown by arrows.

Subsequently, the aerosol particles reaches between the semispherical reflector 31 and the first grid 32, and then the laser generating means emits laser and irradiates the laser to the particles.

The aerosol particles are ionized due to the laser irradiation, and at this time ions are emitted in a radial direction. The inventor has revealed that, as a size of ionized particle is greater, an emitting rate of generated ions is increased, and the ions generated from an atom existing on the surface portion is emitted at a higher rate than those in the center portion in case of a single particle. The emitted ions are extracted by the reflector 31 and the first grid 32, and then biased due to a voltage difference between the second grid 33 and the reflector 31 and accelerated toward the ion detector 14 through the flying tube 13. At this time, the ions are further focused by means of the cylindrical electrode 34 interposed between the first and second grids 32, 33, and then make uniform motions toward the ion detector 14.

The ions passing through the first grid 32, the cylindrical electrode 34 and the second grid 33 are further focused toward the central axis due to an electric field with passing through the Einzel lens 40 (see FIG. 3).

Thus, the ions may mostly reach the ion detector 14 without colliding with the inner wall or disappearing while passing through the flying tube 13.

Advantageous effects of the present invention will be more clearly understood through the following experimental example.

EXPERIMENTAL EXAMPLE

After setting each condition of the single-particle mass spectrometer according to the present invention, SIMION 3D 7.0 ion optics program (U.S. INEEL) was used for simulation. At this time, the reflector 31 was set to have an inner diameter of 1.1 inch and a thickness of 0.05 inch, and the first grid 32 was set to be spaced apart from the reflector 31 by 0.45 inch. The cylindrical electrode 34 having a height of 0.5 inch and a thickness of 0.05 inch was installed at a position spaced apart from the first grid 32 by 0.5 inch, and the second grid 33 was arranged at a position spaced apart from the cylindrical electrode 34 by 0.5 inch. A voltage of 14,000 V was applied to the reflector 31, and a voltage of 6,000 V was applied to the first grid 32 and the cylindrical electrode 34. The second grid 33 was grounded.

In addition, the Einzel lens 40 was installed at a position spaced apart from the second grid 33 by 9.5 inch, and the conductive tubes 41, 42, 43 respectively had a height of 4 inches, an inner diameter of 3.7 inch and a thickness of 0.05 inch, and they were respectively spaced apart from each other by 0.25 inch. A voltage of 1,000 V was applied to the conductive tube 42 at the center.

A distance from the center between the reflector 31 and the first grid 32 to the MCP ion detector was 49.9 inch, and a diameter of an input region of the ion detector was set to be 18 mm.

Figure 5:
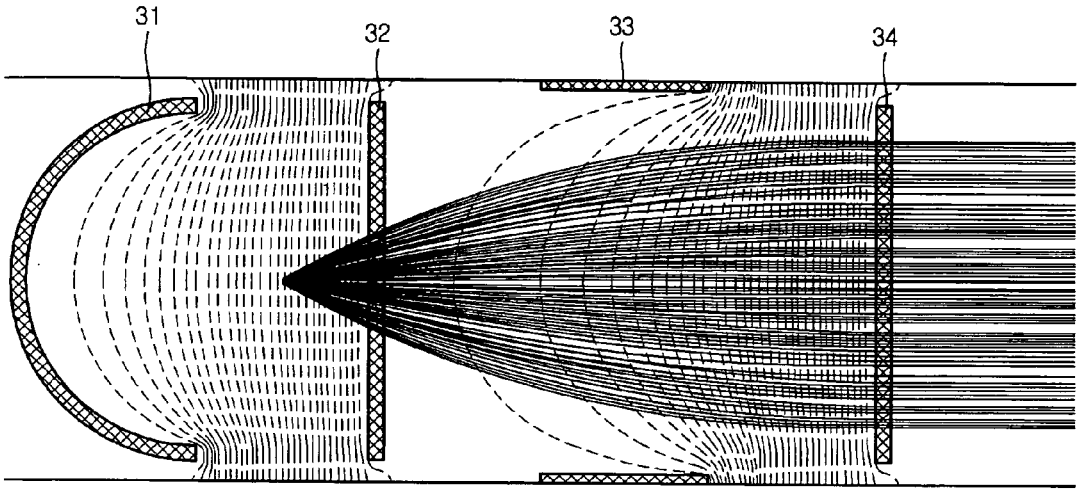
FIG. 5 is a schematic view illustrating the principle of focusing ions by the extraction acceleration means and the cylindrical electrode by simulation in the single-particle mass spectrometer according to the preferred embodiment of the present invention, wherein a dotted line depicts an electric field and a solid line depicts a trajectory of ions.

Under the above conditions, trajectories of the ions ionized by a laser beam between the reflector 31 and the first grid 32 were simulated as is shown in FIG. 5. FIG. 5 shows trajectories of ions having initial kinetic energies of 10, 50 100 and 200 eV influenced by an electric field (dotted lines denote isoelectric lines) at the same time. As seen from FIG. 5, the ions radially emitted are accelerated toward the ion detector, and at the same time focused by the cylindrical electrode 34.

Figure 6:
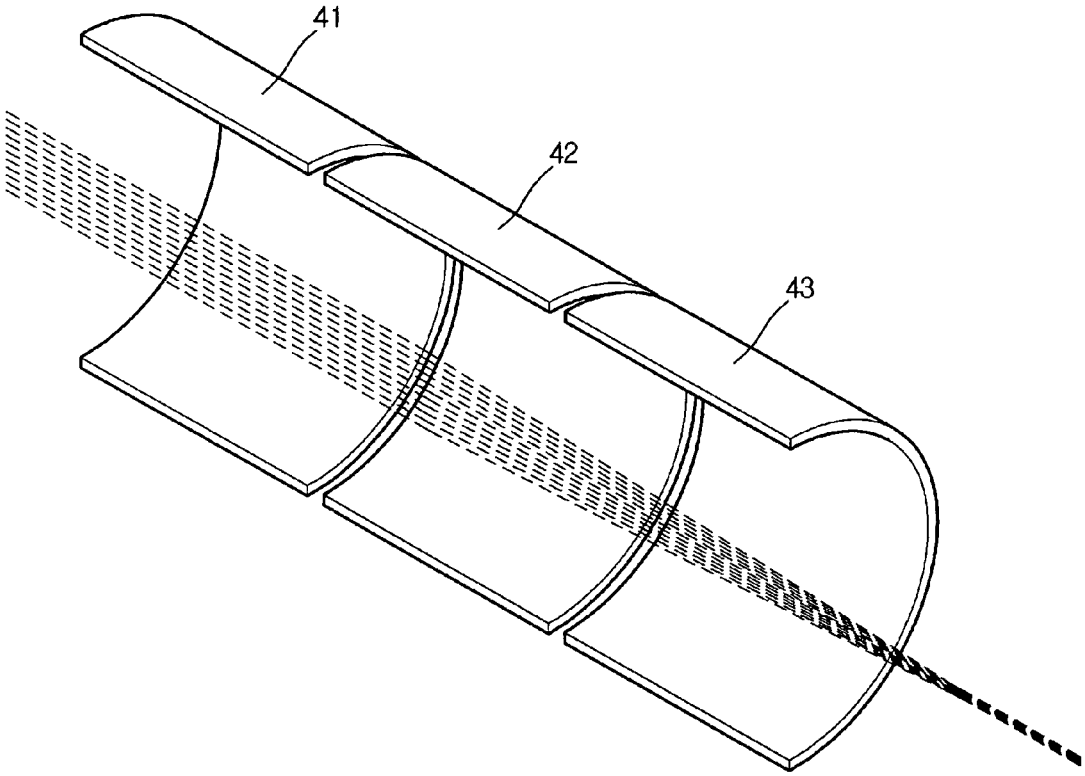
FIG. 6 is a schematic view illustrating the principle of focusing ions toward a central axis by means of the Einzel lens by simulation in the single-particle mass spectrometer according to the preferred embodiment of the present invention.
Figure 7A:
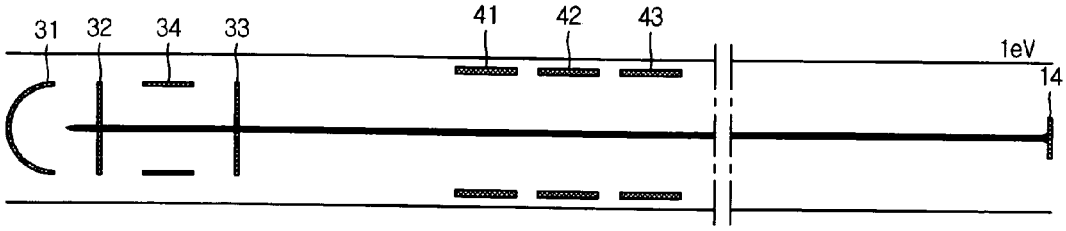
FIGS. 7*a* and 7*d* are schematic views illustrating the principle of focusing ions according to an initial kinetic energy of ions by simulation during the operation of the single-particle mass spectrometer according to the preferred embodiment of the present invention.
Figure 7B:
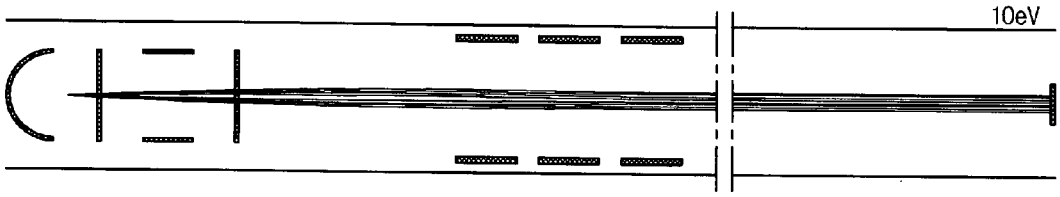
Figure 7C:
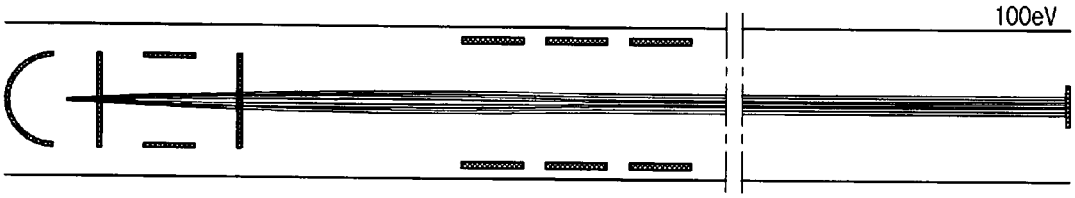
Figure 7D:
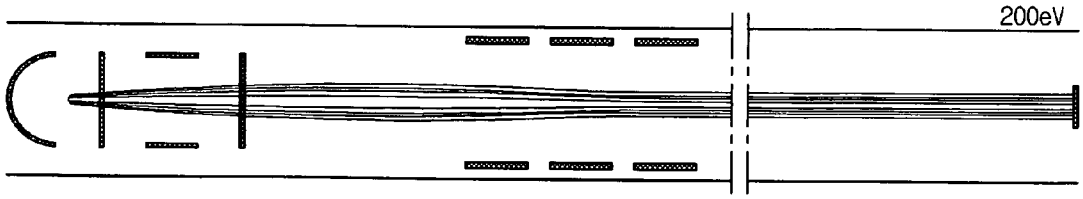

It will be found that the focused ions are further focused toward a central axis with passing through the Einzel lens 40 as shown in FIG. 6.

According to the present invention, the electric field between the semispherical reflector 31 and the first grid 32 makes the ions, emitted at 0° to 360° with respect to a central axis of the flying tube, be directed toward the MCP ion detector. These ions are adjusted substantially in parallel with the central axis direction of the flying tube by means of the cylindrical electrode, and as a result all ions reach the MCP ion detector without excessive focusing. According to the present invention, it was found that ions are excessively focused when only the Einzel lens is applied without a cylindrical electrode.

In this experimental example, in case size and gap of the electrodes are changed, a voltage applied to each electrode should also be changed, but the reflector, the grids, the cylindrical electrode and the Einzel function as they were.

In addition, FIGS. 7*a* to 7*d* show the trajectory of ions according to the difference of initial kinetic energies thereof when particles are ionized.

As seen from FIGS. 7*a* to 7*d*, it would be found that ions advance with spreading out from the central axis as an initial kinetic energy is great. However, it is found that ions having a kinetic energy not greater than 200 eV are all not departing from a measurement region of the ion detector, and thus a measuring efficiency can be improved within the above range. According to this simulation, it can be understood that nearly 100% of measuring efficiency can be obtained for ions having a kinetic energy not greater than 200 eV. Here, it has been revealed that particles of 300 nm or less have a maximum initial kinetic energy of 200 eV in this embodiment. Thus, if mass of particles can be analyzed with a measuring efficiency regardless of an initial kinetic energy of ions, small quantity components existing in surface and inside of particles can be exactly detected. In case of a common particle mass spectrometer, a measuring efficiency is suddenly deteriorated according to the increase of an initial kinetic energy of ions, and ions in the surface have a greater kinetic energy than ions in the inside. Thus, in case of analyzing components of particles whose constitutions are different between inside and outside, there is a possibility of overestimation as if there is much greater constitution in the inside.

Figure 8:
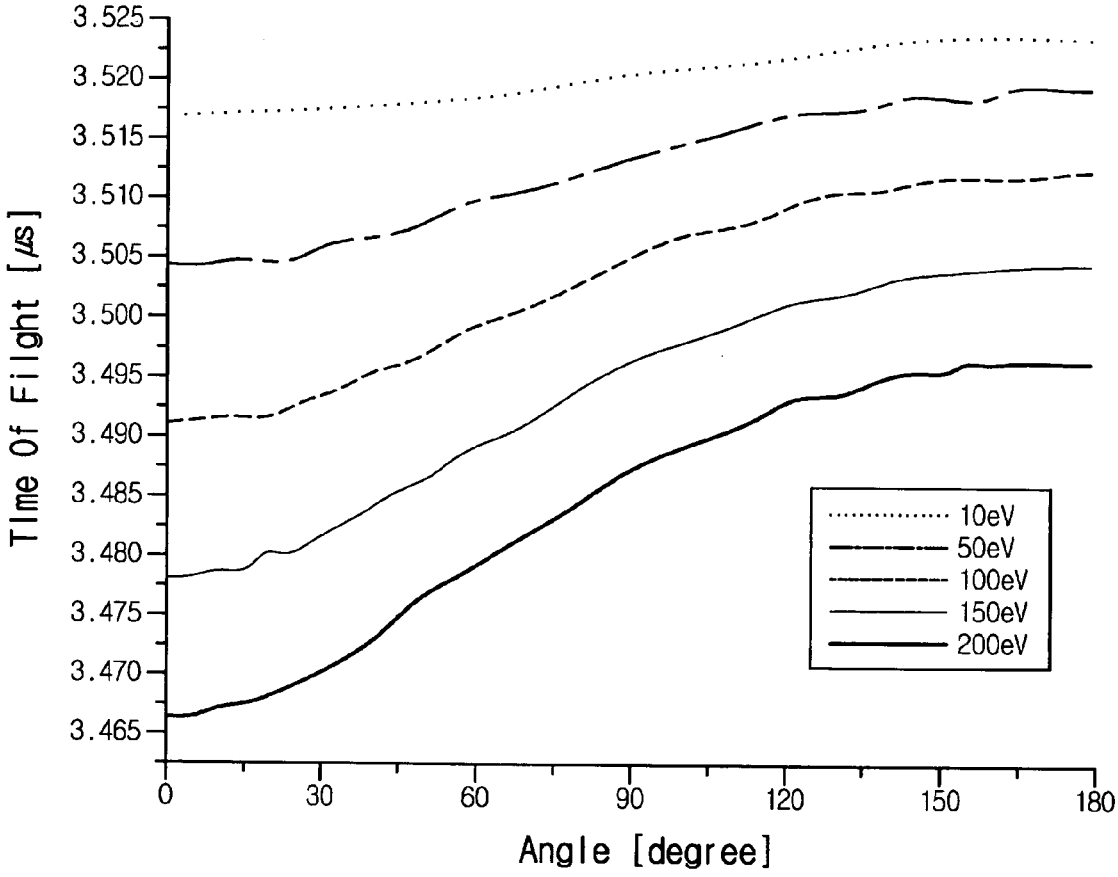
FIG. 8 is a graph showing a time of flight of ions according to an initial kinetic energy of the ions during the operation of the single-particle mass spectrometer according to the preferred embodiment of the present invention.

FIG. 8 is a graph showing a time of flight during which ions radially emitted reach the ion detector, depending on each kinetic energy. As seen from the graph of FIG. 8, the time of flight was satisfactorily in the range of about 3.525 to 3.465 μsec, with a time difference of $\Delta t=0.06$ μsec. As the difference of the time of flight is smaller, a resolution for the mass analysis is increased, thereby allowing more precise constitution analysis.

Figure 9:
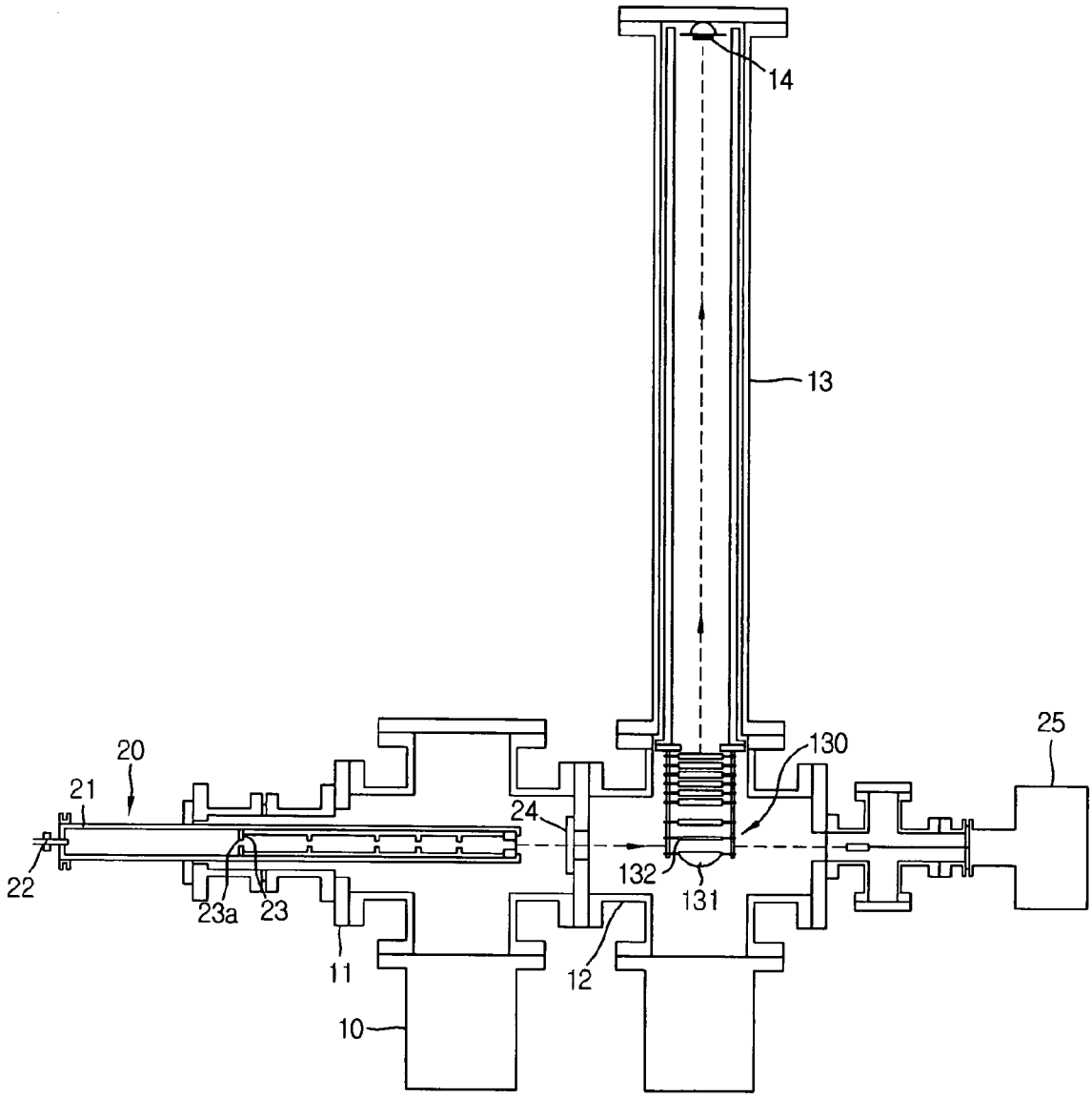
FIG. 9 is a sectional view schematically showing a single-particle mass spectrometer according to another embodiment of the present invention.

FIG. 9 schematically shows a single-particle mass spectrometer according to another embodiment of the present invention. Here, the same reference numeral as in the former drawings denotes the same component.

Figure 10:
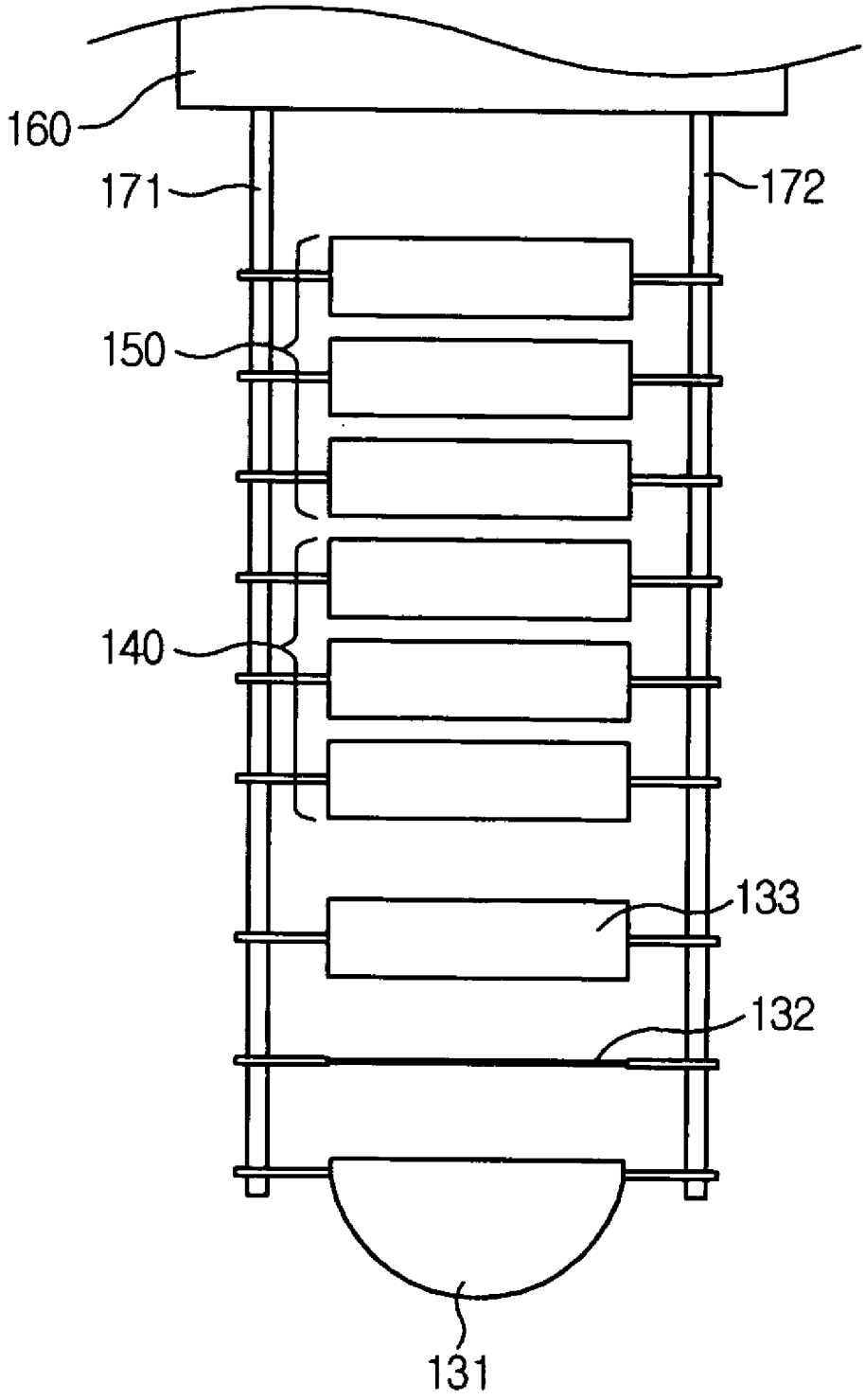
FIG. 10 is a side view showing a module including an extraction acceleration means, a cylindrical electrode and an Einzel lens of the single-particle mass spectrometer according to another embodiment of the present invention.
Figure 11:
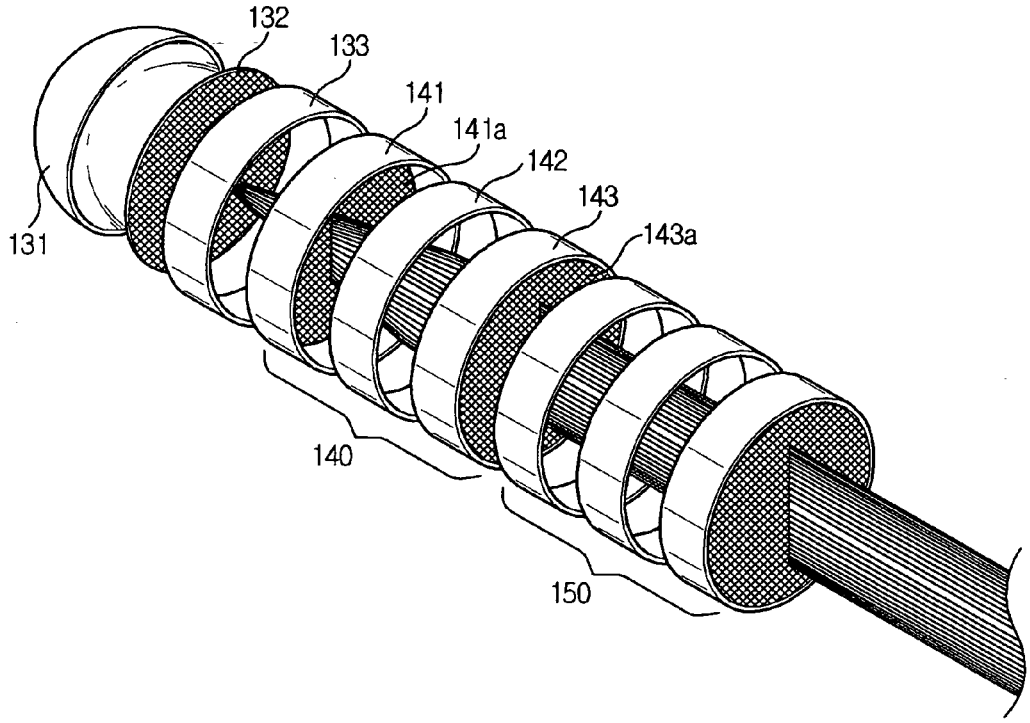
FIG. 11 is a partial perspective view showing configurations of the extraction acceleration means, the cylindrical electrode and the Einzel lens of the single-particle mass spectrometer according to another embodiment of the present invention, in which trajectories of ions obtained by simulation are displayed.

Referring to FIG. 9, an extraction acceleration means 130 is coupled to the input end of the flying tube 13. Referring to FIGS. 10 and 11 schematically showing components of the extraction acceleration means together, the extraction acceleration means 130 includes a semispherical reflector 131 and a grid 132. The semispherical reflector 131 is made of conductive material, and a relatively high voltage is applied thereto so that the reflector 131 plays a role of refracting radially-emitted ions toward the detector.

The grid 132 has a mesh shape and is composed of conductive metal, and the grid 132 is arranged to be spaced apart from the reflector 131 toward the ion detector by a predetermined distance. A relatively lower voltage is applied to the grid 132 in comparison to the reflector 131 so as to extract ions ionized by the laser depending on their masses and accelerate them toward the ion detector.

The cylindrical electrode 133 is installed by the side of the grid 132. The cylindrical electrode 133 is arranged at the same axis as the extraction acceleration means 130 to focus the accelerated ions. A voltage applied to the cylindrical electrode 133 is equal to or higher than that applied to the grid 132.

The Einzel lens 140 is installed by the side of the cylindrical electrode 133. The Einzel lens 140 is composed of first, second and third conductive tubes 141, 142, 143 successively arranged. The first and third tubes 141, 143 at both sides are electrically neutral, but a voltage lower than that applied to the cylindrical electrode 133 is applied to the second tube 142 at the center.

Mesh-shaped grids 141*a*, 143*a* are respectively formed in an input surface of the first conductive tube 141 and an output surface of the third conductive tube 143. These mesh-shaped grids 141*a*, 143*a* effectively focus flying ions at a uniform point.

According to the present invention, at least one Einzel lens, preferably two Einzel lens may be provided. In addition, a second Einzel lens 150 additionally provided may have the same configuration as the first Einzel lens 140, and a voltage lower than that applied to the second tube 142 of the first Einzel lens 140 is applied to the second Einzel lens 150.

In this embodiment, the extraction acceleration means 130, the cylindrical electrode 133 and the Einzel lens 140, 150 can be subsequently coupled onto a flange 160 by means of a pair of supports 171, 172 as an example into a module. That is to say, the flange 160 can be simply attached or detached to/from the input end of the flying tube 13, thereby facilitating easy assembling and maintenance of the device. In this case, the difficulty caused by installing components to a narrow space in the flying tube can be solved.

The inventor has found that, though the semispherical reflector 131 of the single-particle mass spectrometer according to the present invention is replaced with a flat plate reflector, the same effect can be obtained if a voltage applied to each component is adjusted. This embodiment is well shown in FIG. 12. Here, all configurations except for the flat plate reflector 131' are identical to those in the former embodiment. In this case, in order to enhance the extraction acceleration ability, the grid 132 is grounded, and a voltage lower than that applied to the flat plate reflector 131' is applied to the cylindrical electrode 133. In addition, a voltage relatively lower than that applied to the cylindrical tube 133 is applied to the central tube 142 of the first Einzel lens 140 and the central tube of the second Einzel lens 150 so as to subsequently focus the flying ions.

EXPERIMENTAL EXAMPLE

The flat plate reflector 131' has a size of 15×15 mm and a thickness of 0.05 inch. The flat plate reflector 131', the grid 132, the cylindrical electrode 133 and the first Einzel lens 140 are spaced apart from each other by 10 mm, respectively. The cylindrical electrode 133 has a thickness of 0.05 inch. A voltage of 4,500 V is applied to the flat plate reflector 131', the grid 132 is grounded, and a voltage of 1,500 V is applied to the cylindrical electrode 133.

The first Einzel lens 140 and the second Einzel lens 150 are spaced apart by a distance of 8 mm. The conductive tubes 141, 142, 143 respectively have a height of 4 inches, an inner diameter of 3.7 inches, and a thickness of 0.05 inch, and they are spaced apart from each other by a distance of 8 mm. Voltages of 750 V and 590 V are respectively applied to the central conductive tubes of the first and second Einzel lens.

A distance from the center between the reflector and the grid to the MCP ion detector is set to be 49.9 inch, and an input region of the ion detector where ions are input is set to have a diameter of 18 mm.

Figure 12:
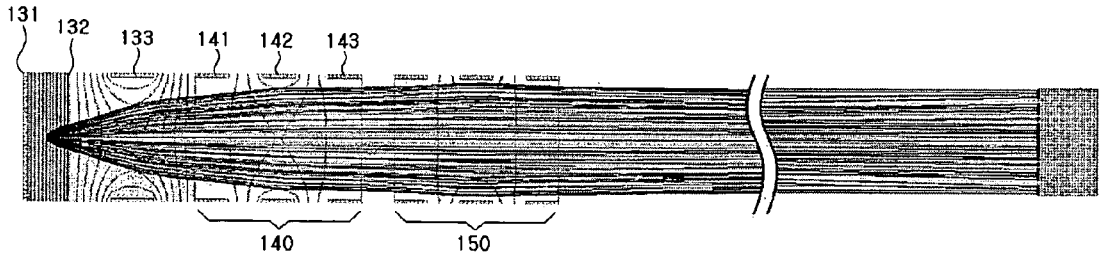
FIG. 12 is a schematic view illustrating the principle of focusing ions by simulation, in the operation of the single-particle mass spectrometer according to another embodiment of the present invention.

FIG. 12 shows a simulation for trajectories of ions ionized by the laser beam between the reflector and the grid under the above conditions. FIG. 12 shows trajectories of ions having initial kinetic energies of 10, 50 100 and 200 eV influenced by an electric field (shown by dotted lines) at the same time. As seen from FIG. 12, it would be found that the ions radially emitted pass are focused, but not excessively, with passing through the cylindrical electrode 133 and the first and second Einzel lens 140, 150, so all ions can reach the MCP ion detector.

APPLICABILITY TO THE INDUSTRY

According to the single-particle mass spectrometer, since ions emitted from a single particle by laser are effectively focused, the ions can reach the ion detector without any loss caused by collision with the inner wall of the flying tube or the like, thereby capable of improving the measuring efficiency.

The single-particle mass spectrometer of the present invention may measure composition and size of a single particle, so it may be used as an ideal measuring tool for revealing chemical reactions generated in a nano level, particle generation, preference for particle sizes of composition, and so on. In addition, the single-particle mass spectrometer of the present invention may look into harmful components of vehicle exhaust particles related to air pollution depending on their sizes.

Though the present invention is explained with reference to the limited embodiments and drawings, it should be understood that there might be various modifications within the scope of the present invention defined in the appended claims.

What is claimed is:

1. A single-particle mass spectrometer, comprising:

a chamber keeping an inside in a vacuum state by a vacuum pump;

a cylindrical flying tube installed to communicate with the chamber;

an aerodynamic lens installed to the chamber to focus aerosol particles input from outside;

a laser generating means for irradiating a laser beam to the particles focused by the aerodynamic lens to emit ions;

an extraction acceleration means for extracting the emitted ions and accelerating the ions to fly along the flying tube, the extraction acceleration means including:

a semispherical reflector made of a conductive material and to which a relatively high voltage is applied, and at least one mesh-shaped grid arranged from the semispherical reflector toward an ion detector at regular intervals, and to which a relatively low voltage is applied in comparison to the semispherical reflector;

a cylindrical electrode arranged at the same axis as the extraction acceleration means and refracting the ions flying by the extraction acceleration means toward a central axis;

an Einzel lens arranged in the flying tube at regular intervals to focus the ions, accelerated and flying by means of the extraction acceleration means, toward a central axis of the flying tube; and the ion detector installed to an end of the flying tube to detect the ions flying along the flying tube, wherein the ions are extracted and accelerated by means of a voltage difference between the semispherical reflector and the grid and fly at a uniform velocity along the flying tube toward the ion detector.

2. The single-particle mass spectrometer according to claim 1 wherein the grid includes:

a first mesh-shaped grid arranged from the reflector toward the ion detector at regular intervals, and to which a relatively low voltage is applied in comparison to the reflector; and a second mesh-shaped grid arranged from the first grid toward the ion detector at regular intervals, and to which a relatively low voltage is applied in comparison to the first grid, wherein the cylindrical electrode is arranged between the first grid and the second grid.

3. The single-particle mass spectrometer according to claim 2, wherein the second grid is grounded.

4. The single-particle mass spectrometer according to claim 2, wherein a voltage applied to the cylindrical electrode is equal to or higher than that applied to the first grid.

5. The single-particle mass spectrometer according to claim 1, wherein the Einzel lens is composed of three conductive tubes successively arranged, and wherein the tubes at both sides are electrically neutral and a voltage is applied to the tube at a center so that an electric field is respectively formed between the tubes.

6. The single-particle mass spectrometer according to claim 1, wherein the chamber includes:

a first chamber to which the aerodynamic lens is installed; and a second chamber to which the extraction acceleration means is installed, the second chamber communicating with the flying tube.

7. The single-particle mass spectrometer according to claim 6, wherein a skimmer for further accelerating the aerosol particles emitted from the aerodynamic lens and at the same time separating the aerosol particles from a carrier gas is provided between the first chamber and the second chamber.

8. The single-particle mass spectrometer according to claim 6, wherein the aerodynamic lens includes:

a cylindrical case having an inlet and an outlet and provided with a decompressing orifice injection hole; and a plurality of focusing lens members installed in the case at regular intervals and having orifice holes at centers thereof through which the aerosol particles are passed and focused.

9. A single-particle mass spectrometer, comprising:

a chamber keeping an inside in a vacuum state by a vacuum pump;

a cylindrical flying tube installed to communicate with the chamber;

an aerodynamic lens installed to the chamber to focus aerosol particles input from outside;

a laser generating means for irradiating a laser beam to the particles focused by the aerodynamic lens to emit ions;

an extraction acceleration means for extracting the emitted ions and accelerating the ions to fly along the flying tube, the extraction acceleration means including:

a reflector made of a conductive material and to which a relatively high voltage is applied, and a mesh-shaped grid arranged from the reflector toward an ion detector at regular intervals;

a cylindrical electrode arranged at the same axis as the extraction acceleration means and refracting the ions flying by the extraction acceleration means toward a central axis;

an Einzel lens for focusing the ions, accelerated by the extraction acceleration means and focused by the cylindrical lens, toward a central axis of the flying tube, the Einzel lens including:

first, second and third conductive tubes successively arranged, and mesh-shaped grids respectively formed in an input surface of the first conductive tube and an output surface of the third conductive tube, wherein the first and third conductive tubes are electrically neutral and a voltage is applied to the second conductive tube at a center; and the ion detector installed to an end of the flying tube to detect the ions flying along the flying tube, wherein the ions are extracted and accelerated by means of a voltage difference between the reflector and the grid and fly at a uniform velocity along the flying tube toward the ion detector.

10. The single-particle mass spectrometer according to claim 9, wherein the reflector has a semispherical shape.

11. The single-particle mass spectrometer according to claim 10, wherein a voltage lower than that applied to the semispherical reflector is applied to the grid of the extraction acceleration means, wherein a voltage equal to or higher than that applied to the grid of the extraction acceleration means is applied to the cylindrical electrode, and wherein a voltage lower than that applied to the reflector is applied to the conductive tubes of the Einzel lens.

12. The single-particle mass spectrometer according to claim 11, wherein the Einzel lens includes:

a first Einzel lens adjacent to the cylindrical electrode; and a second Einzel lens adjacent to the first Einzel lens, wherein a voltage applied to the conductive lens of the second Einzel lens is lower than that applied to the conductive tube of the first Einzel lens.

13. The single-particle mass spectrometer according to claim 9, wherein the reflector has a flat plate shape.

14. The single-particle mass spectrometer according to claim 13, wherein the grid of the extraction acceleration means is grounded, wherein a voltage lower than that applied to the reflector is applied to the cylindrical electrode, and wherein a voltage lower than that applied to the reflector is applied to the conductive tubes of the Einzel lens.

15. The single-particle mass spectrometer according to claim 14, wherein the Einzel lens includes:

a first Einzel lens adjacent to the cylindrical electrode; and a second Einzel lens adjacent to the first Einzel lens, wherein a voltage applied to the conductive lens of the second Einzel lens is lower than that applied to the conductive tube of the first Einzel lens.

16. The single-particle mass spectrometer according to claim 9, wherein a detachable flange is provided to an input end of the flying tube, and wherein the extraction acceleration means, the cylindrical electrode and the Einzel lens are subsequently coupled on the flange by means of a pair of supports.

* * * * *